United States Patent [19]

Korpi

[11] 4,163,705

[45] Aug. 7, 1979

[54] APPARATUS FOR CHEMICAL AND ELECTROCHEMICAL TREATMENT

[76] Inventor: Teuvo T. Korpi, Kaarelanti 97A, 00420 Helsinki, 42, Finland

[21] Appl. No.: 800,148

[22] Filed: May 24, 1977

Related U.S. Application Data

[62] Division of Ser. No. 684,122, May 6, 1976, abandoned.

[30] Foreign Application Priority Data

May 6, 1975 [FI] Finland ..... 751337

[51] Int. Cl.[2] ..... C25D 17/02

[52] U.S. Cl. ..... 204/239; 204/236; 204/247; 204/274; 204/278

[58] Field of Search ..... 204/270, 249, 278, 266, 204/247, 45 R, 49, 51, 274, 237, 238

[56] References Cited

U.S. PATENT DOCUMENTS

| | | | |
|---|---|---|---|
| 1,354,451 | 9/1920 | Bergve | 204/247 X |
| 1,597,231 | 8/1926 | Haynes | 204/247 X |
| 3,661,732 | 5/1972 | Withrow | 204/45 R X |
| 3,876,389 | 4/1975 | Chaudhari et al. | 204/49 X |

*Primary Examiner*—Arthur C. Prescott

*Attorney, Agent, or Firm*—Ladas, Parry, Von Gehr, Goldsmith & Deschamps

[57] ABSTRACT

An electroplating apparatus for applying a protecting metallic coating on the surface of a workpiece, the apparatus featuring a process chamber for containing an electrolytic solution, and means for leading an electric current to the workpiece and to the solution. A pneumatic pressure reducing pump is further provided for creating subatmospheric pressure about said process chamber and the spaces containing said electrolytic solution which is in communication with the electrolytic solution in the process chamber, whereby the use of a high electrical current density during electroplating is possible.

16 Claims, 3 Drawing Figures

APPARATUS FOR CHEMICAL AND ELECTROCHEMICAL TREATMENT

Figure 1:
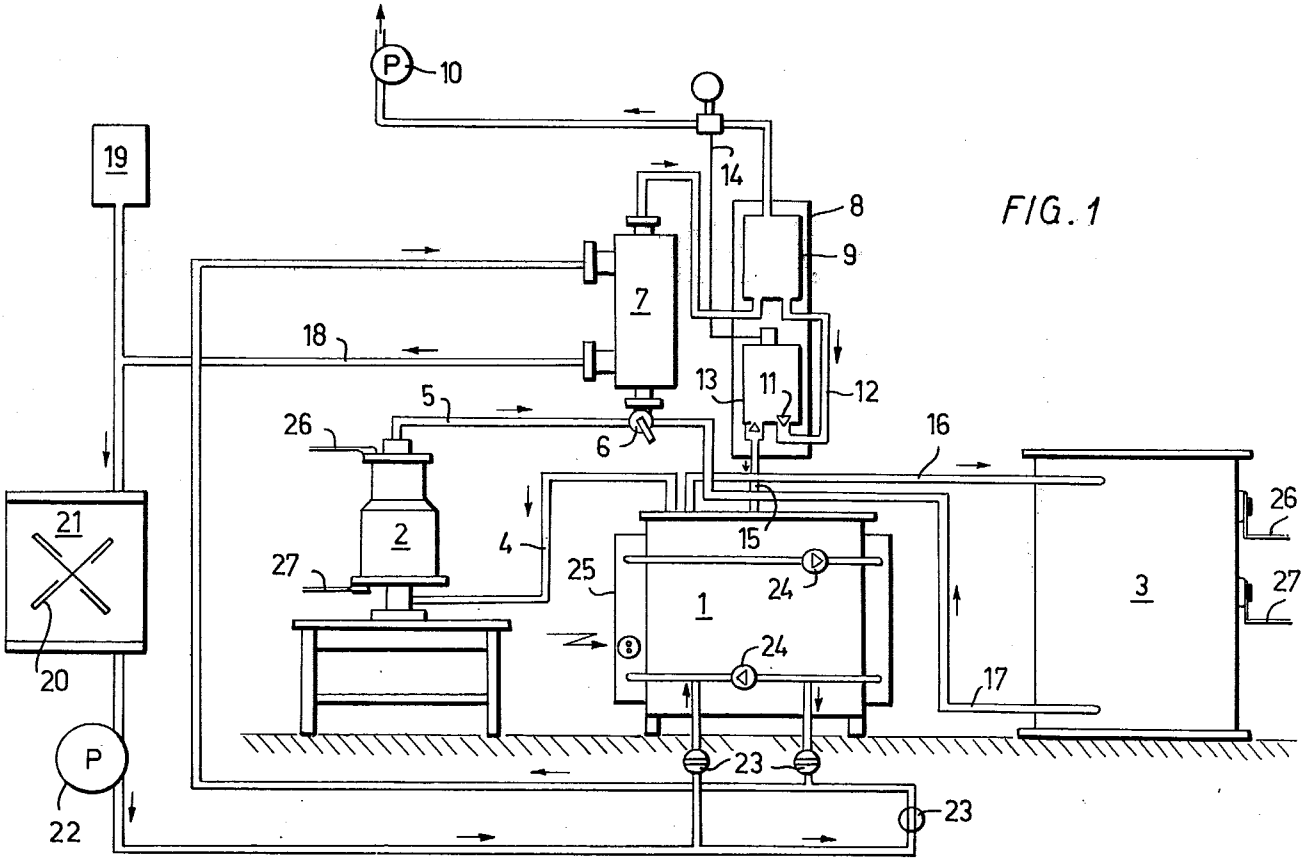

This is a division of application Ser. No. 684,122 filed May 6, 1976 now abandoned.

Known electrolytic processes have relatively many technical and environmental disadvantages. The technical disadvantages include variations in the thickness of the coating, slow growth, poor density and poor adherence of the coating. These are, however, only a few of the most obvious difficulties. The biggest problem probably is the irregular growth of the coating, appearing mainly as a so called outgrowth, i.e. the coating grows in certain sections much too quickly.

As far as environment protection and work protection are concerned, the biggest problem in the known processes is the abundant formation of gas and mist fumes. The developed gases and fumes are toxic and cause occupational diseases.

It is the object of the invention to provide a process by means of which most of the disadvantages connected with the known processes can be eliminated.

Thorough tests have proved that the process according to the invention which is based on electrolytic coating under reduced pressure, provides a number of unexpected advantages. The quality of the coating is considerably improved and the mist fumes which normally develop during the process are bound already at a lowered pressure of only 0.85 atm to the circulating electrolyte. Since the quantity of mist fumes also depends on the electrolyte used and the current density, it is advisable, for additional security, to use a still lower pressure, i.e. a pressure which is smaller than 0.8 atm.

The most advantageous way is to have the process space proper only under reduced pressure and to let the electrolytic solution circulate through this space. It will then be possible to utilize the circulation system to provide a proper cooling and heating. It is also possible to use an apparatus where there is no circulation of liquid and where the electrolyte storage space also serves as process space.

It is further possible and in some instance especially advantageous to simplify the process and the apparatus used for the application of the process by forming the process space so that a container which is open at its other end is arranged in upsidedown position with the opening below the liquid level in an electrolyte container and is coupled to a source for reducing the pressure so that the upsidedown container, due to the reduced pressure developed therein, is filled with electrolytic liquid to the desired level. Through this method, a conventional apparatus can quite easily be changed for use in the process according to the invention. The electrolyte container can simultaneously serve as storage space for the electrolytic liquid of the system, whereby only one container is required.

As has appeared, it is not necessary for the lower pressure to prevail in the process space proper. The main thing is that the electrolyte circulates through a space where the pressure is low enough. This prevents the formation of mist fumes and harmful gases which as such is a big advantage. The effect of the reduced pressure on the electrochemical process itself will, of course, be closer to atmospheric pressure the smaller the underpressure is, but since conventional quality in many cases is quite sufficient in coating operations, the process according to the invention can also be applied as described above. The environmental advantages of the process can then be utilized in full with extremely simple additional equipment and at a low cost.

Good results can be obtained when the difference between the free liquid level of the electrolyte container and the highest point in the lowered pressure system is approx. 1.5 m. The highest point of the lowered pressure system can be located outside the process space itself. When the electrolytic liquid circulates through the process space and the underpressure system connected thereto, it is advantageous to arrange an air cushion at the upper end of the process space in order to be able to pull necessary power supply cables through the process space casing at a point where there is no contact with the electrolytic liquid. This makes handling of packing problems easier when the cables are lead in.

An apparatus for the application of the process according to the invention comprises an electrolyte container, an underpressure chamber and a sluice device, through which the liquid which has flown from the electrolyte container to the process chamber can be lead back to the electrolyte container. The sluice device can be of a type known per se, for example, in principle of the same kind as the so called releasers used in milking machines. From the electrolyte container, the electrolytic liquid can be sucked directly to the pressure chamber by means of the lowered pressure in the chamber, but it can also be pumped.

Because the electrolytic liquid is heated in an electrolytic process, cooling is generally required. In an apparatus according to the invention, cooling can be provided, for example, by arranging a heat exchanger between the process chamber and the sluice device, said heat exchanger being connected to the electrolyte circulation system and to a cooling system. Eventually, cooling may also be required in the electrolyte container, or in some instances heating. In order to obtain the required temperature, the electrolyte container can be provided with suitable temperature regulators. These regulators are advantageously connected to the same cooling liquid system as the heat exchanger of the electrolyte circulation system.

An apparatus according to the invention can be advantageously provided with a plurality of pressure chambers of different sizes for coating of objects of different sizes. The system can be so constructed that the various pressure chambers can be used simultaneously or alternatively.

Figure 2:
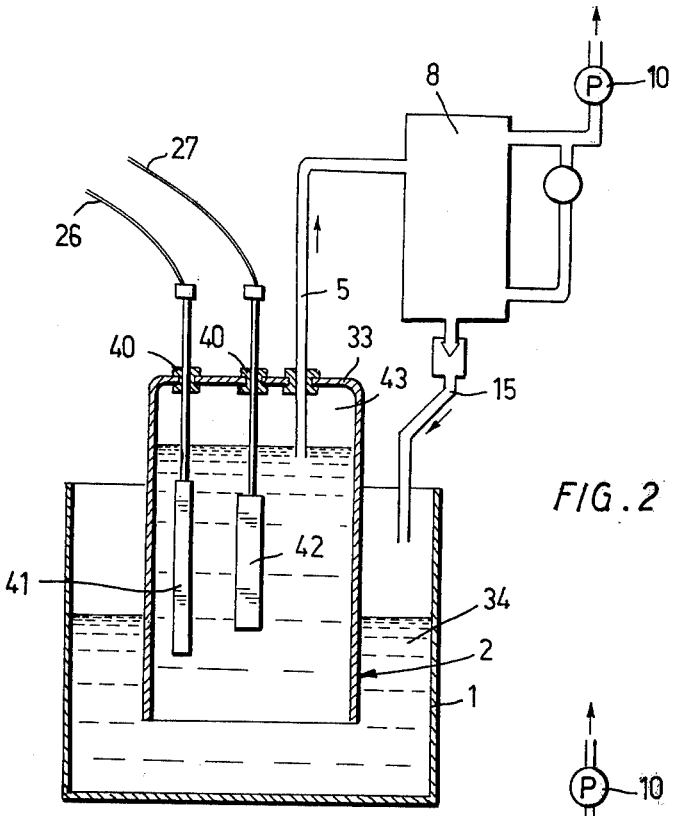
Figure 3:
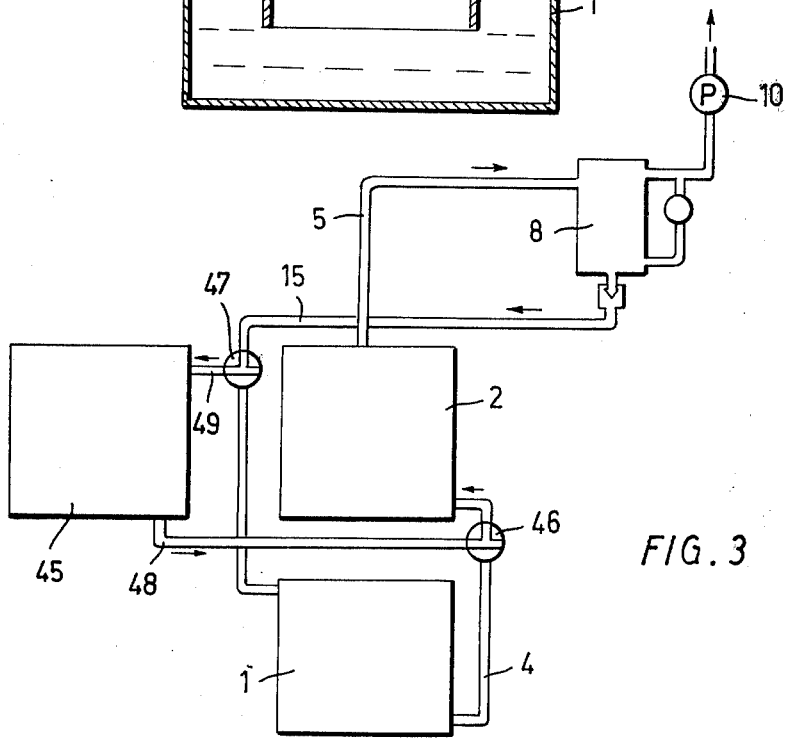

The invention will now be described with reference to the accompanying drawings where FIG. 1 is a schematic view of a first embodiment of an apparatus according to the invention, FIG. 2 is a schematic view of a second embodiment of an apparatus according to the invention, and FIG. 3 is a schematic view of a third embodiment of an apparatus according to the invention.

In FIG. 1, 1 denotes an electrolyte container, 2 a smaller process chamber and 3 a bigger process chamber. From the electrolyte container 1, a connecting pipe 4 leads to the smaller process chamber 2. Through this pipe, the electrolyte is sucked from the container 1 to the process chamber 2, and from there continues to circulate through a pipe 5 and a three way valve 6 to a heat exchanger 7 where the circulating liquid is cooled, when necessary. From the heat exchanger 7, the liquid continues to circulate to the upper chamber 9 of a sluice device 8. The circulating liquid is maintained under a reduced pressure because a vacuum pump 10 is coupled to the upper chamber 9 of the sluice device. From the upper chamber 9, the circulating liquid flows through a non-return valve 11 and a pipe 12 to the lower chamber 13 of the sluice device 8 when this chamber is under a reduced pressure. After the lower chamber 13 has been filled to a certain level, the control of the sluice device cuts off the connection 14 between the lower chamber 13 and the vacuum pump 10 and connects the lower chamber to the atmosphere. The electrolyte then flows by its own weight through a pipe 15 to the electrolyte container 1.

The electrolyte can also be sucked through a connecting pipe 16 to the bigger process chamber 3 and from there through a pipe 17 and the three way valve 6 further to the heat exchanger 7 and sluice device 8. The desired circulation is selected by adjusting the three way valve 6. The valve can also be constructed so that the electrolyte simultaneously circulates both through the smaller and the bigger process chamber.

The apparatus shown in FIG. 1 also comprises a closed cooling liquid circuit 13 comprising an expansion vessel 19, a cooler 21 activated by a fan 20, a circulation pump 22 as well as necessary auxiliary equipment, such as, e.g. closing valves 23 and back stroke valves 24. The cooling liquid circulates through the heat exchanger 7 and, when necessary, also around or through the electrolyte container 1. Sometimes, for instance in the initial stage of the process, the temperature of the electrolyte may be too cold and heating is thus required. For heating the electrolyte, the electrolyte container is provided with an electric heating apparatus 25.

The actual coating process takes place in the process chamber 2 or 3, usually activated by an outer supply of electric power. The power is supplied through cables 26 and 27. In principle, the process is a conventional electrolytic coating process.

In FIG. 2, the process chamber 2 is immersed in the electrolyte container 1 and is open in the lower end. Because the process chamber 2 is connected to a vacuum pump 10, the electrolytic liquid 34 in the electrolyte container 1 will rise to a desired level in the process chanber 1. From the process chamber 2, the electrolyte flows further through the pipe 5 to the sluice device 8 and from there back through the return pipe 15 to the electrolyte container 1. The Figure also shows quite schematically power supply cables 26 and 27, their lead-ins 40, electrodes 41 and a workpiece 42. An air cushion 43 is formed at the lead-ins 40 in the process chamber 2 preventing the cable lead-ins from getting into direct contact with the electrolyte.

The apparatus according to FIG. 3 essentially corresponds to the apparatus according to FIG. 1. It is, however, completed with a rinsing fluid container 45 which, by means of three way valves 46 and 47 can be connected to the circulation system of the electroly liquid instead of the electrolyte container 1. When the electrolyte container 1 is disconnected from the circulations system and the rinsing fluid container 45 is connected to the circulation system, the rinsing fluid circulates from the rinsing fluid container 45 through the pipe 48 and the three way valve 46 to the process chamber 2 where the workpiece is rinsed. The rinsing fluid flows further in the usual way through the pipe 5, sluice device 8 and return pipe 15 as well as through the three way valve 47 and pipe 49 back to the rinsing fluid container 45. This embodiment of the invention has the advantage that the workpiece need not be moved for rinsing, but can be rinsed in the process chamber itself by using the same low pressure circulation system as during the actual process. In this way, rinsing can take place quickly and with a minimum of waste time.

The following hard chromium plating process can be mentioned as an example of a successful coating by means of the process according to the invention. The electrolyte was a so called selfregulating electrolyte (SRHS), and the temperature was adjusted in accordance with the recommendations of the electrolyte manufacturer. With a pressure of 0.85 atm in the process space, the density of current could be raised up to a value of 100 A/dm$^2$. Despite this, an extremely tight and even coating was obtained.

Process conditions:
Electrolyte: SRHS 110
Temperature: 60° C.
Current density: 30 A/dm$^2$
Object: Cylindrical cast iron tube The invention is not limited to the emdodiments described, but a number of variations and modifications are feasible within the frames of the following claims.

What I claim is:

1. An electroplating apparatus for applying a protective metallic coating on the surface of an object, said apparatus comprising chamber means and liquid electrolyte solution in the chamber means, said chamber means including a process chamber which contains at least a part of said liquid electrolyte solution and in which said object may be submerged in the liquid electrolyte solution, and the apparatus further comprising means for leading an electric current to said object and to said solution, said process chamber being provided with means for effectively preventing atmospheric air from flowing through said chamber, and a pneumatic pressure-reducing pump connected to the chamber means to maintain a reduced pressure, which is substantially below atmospheric, above the electrolyte solution within at least a part of the chamber means.

2. An apparatus as claimed in claim 1, wherein the chamber means further include a second chamber and means connecting said part of the chamber means between the process chamber and the second chamber, whereby electrolyte solution may be caused to flow from said process chamber to said second chamber by way of said part of the chamber means.

3. An apparatus as claimed in claim 2, wherein said part of the chamber means comprises a third chamber which is disposed above the process chamber, the third chamber is connected to the second chamber by a conduit which is provided with a non-return valve permitting flow from the third chamber to the second chamber but preventing flow from the second chamber to the third chamber by way of said conduit, said pneumatic pressure-reducing pump is connected to said third chamber to draw electrolyte solution from the process chamber into the third chamber, and the apparatus further comprises means for reducing pressure in said second chamber below the pressure in said third chamber, thereby to permit flow of electrolyte solution from the third chamber to the second chamber.

4. An apparatus as claimed in claim 2, wherein the chamber means further include conduit means connecting said second chamber to the process chamber independently of said part of the chamber means, whereby electrolyte solution may be caused to circulate from said process chamber, through said part of the chamber means, said second chamber and said conduit means, and back to said process chamber.

5. An apparatus as claimed in claim 1, further comprising heat exchanger means for obtaining proper heating or cooling of the electrolyte solution.

6. An apparatus as claimed in claim 5, wherein the process chamber and said part of the chamber means are connected in an electrolyte circuit and a heat exchanger is connected between the process chamber and said part of the chamber means for regulating the temperature of the circulating electrolyte solution to a desired value.

7. An apparatus as claimed in claim 4, wherein the chamber means further include an electrolyte container separate from said process chamber for simultaneously serving as a storage space for said electrolyte solution.

8. An apparatus as claimed in claim 7, wherein said electrolyte container includes temperature regulating means.

9. An apparatus as claimed in claim 5, wherein the heat exchanger means comprise several heat exchangers and a common cooling system which is connected to the several heat exchangers.

10. An apparatus as claimed in claim 3, wherein the chamber means include a storage container for electrolyte solution and the process chamber is open at one end and is disposed with its open end under the level of the liquid in said storage container, the process chamber being filled with electrolyte solution to a desired level due to the reduced pressure provided by said pump.

11. An apparatus as claimed in claim 10, wherein the second chamber is connected to discharge electrolyte solution into said storage container, and wherein the difference between the level of the free surface of electrolyte liquid in said storage container and the highest point reached by the electrolyte liquid under lowered pressure is at least 1.5m.

12. An apparatus as claimed in claim 10, wherein an air-cushion is provided in the upper end of the process chamber and cable lead-ins are arranged in the part of the process chamber where the air-cushion is located.

13. An apparatus as claimed in claim 1, including at least two process chambers of different size, for treating objects of different size.

14. An apparatus as claimed in claim 7, including at least one rinsing fluid container connectable to the electrolyte circulation system of the apparatus in lieu of said electrolyte container, whereby rinsing of an object in the process chamber can take place by using the same liquid circulation means as is employed during the coating process.

15. An apparatus as claimed in claim 1, wherein said pump provides a pressure up to 0.85 atm absolute pressure.

16. An apparatus as claimed in claim 1, wherein said pump provides up to maximum 0.8 atm absolute pressure.

* * * * *